US005472324A

United States Patent [19]

Atwater

[11] Patent Number: 5,472,324

[45] Date of Patent: Dec. 5, 1995

[54] PAGE PACK HAVING NOVEL HEAT SINK ARRANGEMENT FOR PUMP MOTOR DRIVE UNITS

[76] Inventor: Richard G. Atwater, 112 Smith Ave., Rockford, Ill. 61107

[21] Appl. No.: 258,095

[22] Filed: Jun. 10, 1994

[51] Int. Cl.[6] ..... F04B 21/00; F04B 11/00; B41J 29/377

[52] U.S. Cl. ..... 417/423.8; 417/313; 417/539; 347/18

[58] Field of Search ..... 417/313, 423.8, 417/415, 539; 347/18, 54

[56] References Cited

U.S. PATENT DOCUMENTS

| | | | |
|---|---|---|---|
| 4,191,240 | 4/1980 | Rule et al. | 417/423.8 |
| 4,281,597 | 8/1981 | Dressler | 101/365 |
| 4,521,805 | 6/1985 | Ayata et al. | 347/18 |
| 4,539,570 | 9/1985 | Moore | 347/54 |
| 4,985,715 | 1/1991 | Cryphert et al. | 347/54 |
| 5,066,964 | 11/1991 | Fukada | 347/18 |
| 5,092,748 | 3/1992 | Simmons, II | 417/423.1 |
| 5,121,130 | 6/1992 | Hempel et al. | 347/18 |

*Primary Examiner*—Richard A. Bertsch
*Assistant Examiner*—Ted Kim
*Attorney, Agent, or Firm*—James T. FitzGibbon

[57] ABSTRACT

A page pack for a printing press wherein the housing for the ink pump and motor assemblies also serves as a heat sink for the heat generated by the motor drive units. The housing comprises a body for receiving a plurality of positive displacement ink pumps each comprising a pump cylinder and at least one pump piston, with all such bores being arranged substantially parallel to each other and lying in a given plane. The housing includes openings for accommodating pump drive motors with their output shafts arranged so as to lie parallel to each other and in a plane slightly offset from an intersecting plane in which the pumps are positioned. The pump housing further includes means for positioning a motor control circuitboard in the housing such that a plurality of individual high current driver units each has its own metal heat sink, and such that these individual heat sinks are secured in use to a master metal heat sink either positioned adjacent or forming a part of the housing, whereby there is an intimate heat exchange relation between the motor driver units and the housing.

10 Claims, 2 Drawing Sheets

PAGE PACK HAVING NOVEL HEAT SINK ARRANGEMENT FOR PUMP MOTOR DRIVE UNITS

BACKGROUND OF THE INVENTION

The present invention relates generally to components of large printing presses, and in particular, to an advantageous construction and arrangement of controls for the "page pack" portion of the system used to deliver ink to the inking rolls of such large printing presses.

By way of background, the mechanism used to ink the rollers in large scale, high speed printing presses, such as those used to print daily newspapers, has several important components, namely, an orifice plate, an ink rail and several ink pump assemblies. The orifice plate receives a supply of ink from a pumping system and forms and positions a film or bath of ink adjacent the inking roller of the press, which in turn picks up the ink and transfers it to an impression roller.

The ink rail component usually supports four pump assemblies by positioning the pump housings in a desired relation to the other components. Each pump housing customarily positions six or eight ink pumps, one for each column of the page being printed. Cumulatively, the housing and one set of ink pumps, their associated drive mechanism, the drive controls, and the associated fittings and manifolding are sometimes called a "page pack." Here, a page pack is contained within the width of one page of a newspaper, i.e., approximately 13–14 inches.

In presses dating back several years, the ink pumps themselves were of a valveless, positive displacement type pump utilizing rod-like piston with a chordwise relief on one end, movably received in a ported cylinder. The piston rotated and reciprocated within the cylinder, drawing in and expelling ink through inlet and outlet ports. These pumps are constructed and arranged in a known manner such that with one portion of the working cycle, the piston is withdrawn at the time the relief is indexed with an inlet passage. This withdrawal motion pulls ink by suction through the inlet port and into a closed end working chamber. In a second portion of the operating cycle, the piston strokes back towards the closed end of the cylinder at the same time its rotary motion indexes the relief with an outlet port in the opposite side of the cylinder. This movement causes the ink that has just filled the working chamber of its cylinder to be displaced outwardly through the exhaust port. As the rotation and reciprocation of the piston continue, this cycle is repeated.

In the recent past, approximately 10 or more years ago, the drive mechanism for some of these pumps was changed significantly. In the older style pumps, a mechanical master drive system operated through a power train of gears and shafts to rotate and stroke the ink pump pistons. Volume control was achieved by varying the angle between the driving and the driven elements. Because pump output per cycle is dependent on the effective angle between the rotational axes of the piston and cylinder on the one hand and the driving member on the other hand, some sort of angle-changing mechanism was required.

The prior art used complex mechanical arrangements for varying this effective angle (minimizing the angle down to and including zero when pump output was to approach and reach zero), and such arrangements created significant maintenance and quality control problems as well as being expensive initially.

Because the industry recognized its many shortcomings in the approach of changing ink pump output rate by varying the driving member/driven member angle as explained above, a different kind of drive system was developed some years ago. This system provided individual electric drive motors for each pump assembly instead of using a common drive source. Now, volume control is achieved on a continuous basis by utilizing a stepping motor for each pump, and an electronic digital control arrangement. Such an arrangement is sometimes termed a "digital" page pack.

In this arrangement, one output pulse from a driver circuit causes the stepping motor to move one step, and this in turn causes the pump to rotate a very small fraction of one complete rotation. Typically, one complete 360° revolution requires 300 to 400 individual steps, and hence, in the case of a 400 step motor, 400 individual pulses would be required to achieve one rotation.

The time interval between pulses determines the rate; the longer the interval, the slower the rate. The advantage of such a control system is that both true zero movements as well as very minute pump movements may be achieved.

With a system wherein the page pack includes six or eight stepping motors and six or eight pumps, each motor can be driven at its own rate, entirely independently of the rate of any other motor. This rate is established by the operator, and control of each pump rate is achieved by inputting signals at a control keyboard. Accordingly, a microprocessor keyboard can be used to set the output rate of each of the individual pumps, thereby varying the amount of ink fed to a counterpart portion of the orifice plate with each pump revolution. Thus, if the impression cylinder printing a newspaper page had a large ink requirement near the center of the page and a great deal of "white space" near the margins, then the individual pumps near the center of each page pack will be made to operate at a relatively higher rate to furnish more ink in keeping with the requirements of the inking roller, whereas the peripheral pumps would operate at a lower or zero settings because the ink demand for a white space area of the paper is much less.

Referring now to the aspect of overall press speed, the amount of ink consumption for a given ink density is also directly proportional to press speed, which itself is variable. In this connection, a second advantageous feature of the above stepping motor control arrangement is that the overall, real-time frequency of these stepper motor drive pulses may be increased or decreased by an overall rate controller which is in turn slaved to or governed by a tachometer system. Accordingly, once the relative control rate for the individual pumps is set, ink delivery at a certain rate is assumed. However, if the press speed as a whole decreases, then it is necessary to decrease the rate at which all of the individual ink pumps operate in order to compensate for the reduced ink demand. The converse is true; in the event the press begins running at a comparatively higher speed, the rates of all the pumps must increase in direct proportion to press speed.

Accordingly, known control systems am able to establish a series of settings which establish the relative rate flow of the individual ink pumps within all of the page packs, and these relative settings are kept proportional to press speed by a tachometer system that takes actual press speed into account.

Even with the improved page packs of the type just referred to, there has been a need for further improvement, inasmuch as the reliability and maintainability of such systems has not been as great as might be desired. In this connection, it must be realized that considering the enormous number of impressions made by newspaper printing presses, and the requirement that daily papers be printed on an almost continuous basis, the need for high reliability cannot be over emphasized.

In prior arrangements, over a particular period of time, a few of the output driver units typically operated almost continuously, while other driver units operated only intermittently or sometimes not at all. Thus, each of the driver chips developed a different temperature rise. Although the heat sinks associated with these chips were adequate under some conditions, it is accepted that lower temperature operation is more favorable to durability and reliability than is operation at or near the peak permissible operating temperature of the output driver chips.

In these past arrangements, particularly where the array of chips was located adjacent a keyboard or other control remote from the pumps and motors, favorable heat dissipation arrangements were not able to be achieved. It would be desirable if a heat sink arrangement could be made such that the temperature rise in certain chips would still be relatively modest even if such chips were operating continuously. By providing the combination of a greater heat sink capacity, as well as the ability to spread or dissipate the heat, particularly to those areas which am inherently cooler-running, better reliability is possible.

According to the invention, the arrangement of the driver chips on the board can enable the mass and the inherent heat capacity of the pump housing to be utilized in such a way as to improve reliability and serviceability of the electronic components in the page pack.

According to the present invention, it has been found possible to do away with remote positioning of certain parts or components of the control system, whereby only the keyboard and a few other elements need be positioned near the operator or pressman, while the others can be positioned adjacent the page pack, i.e., near the individual pumps and motors. In this arrangement, better packaging, and especially better control of generated heat, can be achieved, resulting in increased longevity and decreased service requirements. Thus, certain elements of the ink control system, particularly the motor and pump housings and the printed circuitboard comprising most of the motor control and drive circuits can be effectively arrayed to achieve optimum temperature rise control. In this way, their reliability can be significantly increased. According to the invention, an improved arrangement of packaging for these components has been provided with such arrangement being economical, effective and achievable at modest cost.

In view of the failure of the prior art to provide printing ink pump packages of optimum reliability and economy, it is an object of the present invention to provide an improved digital page pack, or pump-motor-and control system for printing press ink pumps.

A further object of the invention is to provide a component mounting arrangement with improved control of electrically generated heat.

Another object of the invention is to provide an improved page pack wherein a single housing for the pumps positions the motors and also includes a flanged body and a master heat sink rail that is in intimate heat exchange relation with the heat sinks on the output drivers for the stepping motors used to control the ink pumps.

A still further object of the invention is to provide an arrangement whereby, on a printed circuitboard type control assembly, plural high current output driver units, each having its own small heat sink, are arrayed in a common plane and arranged to be fastened to a metal element serving as a master heat sink.

Yet another object of the invention is to provide an arrangement of heat sink materials, including a portion which is integrally cast with the page pack pump and motor housing and another master heat sink portion which may be fixed to the integrated heat sink elements on the output drivers and thereafter placed in intimate heat exchange relation with the remainder of the housing.

A still further object of the invention is to provide a control system for an array of printing press ink pumps which includes housing having openings for receiving ink pump and the output shafts of individual drive motors, a mounting surface for the drive motors, and end and sidewall housing flanges, with each flange including a slot for receiving a circuitboard, and with one flange including a master heat sink mounting surface, so that with the margins of a circuitboard disposed within and positioned by the slots, the master heat sink can be fastened both to the individual heat sinks forming a part of the circuitboard and to flange on the housing.

Another object of the invention is to provide an improved arrangement for component mounting in an ink pump system, wherein the control system includes a remote keyboard, pump drive circuitry on a circuitboard, with the drive components of the circuitboard being positioned adjacent the pump motors and in intimate heat exchange relation with the housing for the motors.

The manner in which the foregoing and other objects of the invention are achieved in practice will become more fully apparent when reference is made to the following detailed description of the preferred embodiments of the invention set forth by way of example and shown in the accompanying drawings, wherein like reference numbers indicate corresponding parts throughout.

DESCRIPTION OF THE PREFERRED EMBODIMENT OF THE INVENTION

Figure 1:
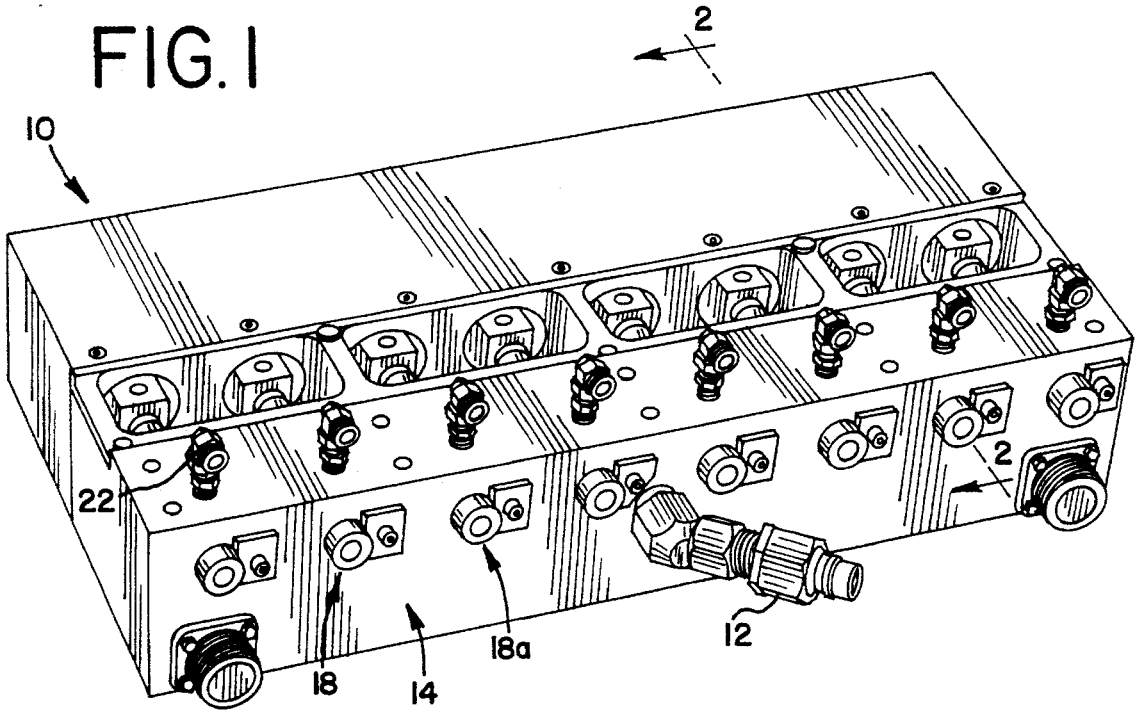
FIG. 1 is a perspective view of a so-called page pack assembly made according to the invention.

Referring now to the drawings in greater detail, FIG. 1 shows what is normally a termed "digital page pack," generally designated 10, and shown to include several major components. As discussed, the purpose of the page pack is to supply ink to what is termed an "orifice plate" adjacent the inking roller of a large printing press. Thus, the page pack 10 includes a fitting 12 which is in communication with an ink supply. The ink passes into the interior of a cast or other monolithic housing generally designated 14 and shown (FIG. 2) to include a plurality of cylindrical bores 16 for receiving positive displacement pumps generally designated 18. The ink passing through the inlet fitting 12 passes through a manifolding arrangement within the cast housing 14; interior passages such as the passage 16 supply the ink to the various individual pumps 18, 18A, etc. After emerging from the pumps 18, the ink passes through individual vertical passages 20 and into the interior of outlet fittings 22. Hoses or other fluid tight lines connect the fittings 22 to the various locations on the orifice plate (not shown).

Figure 2:
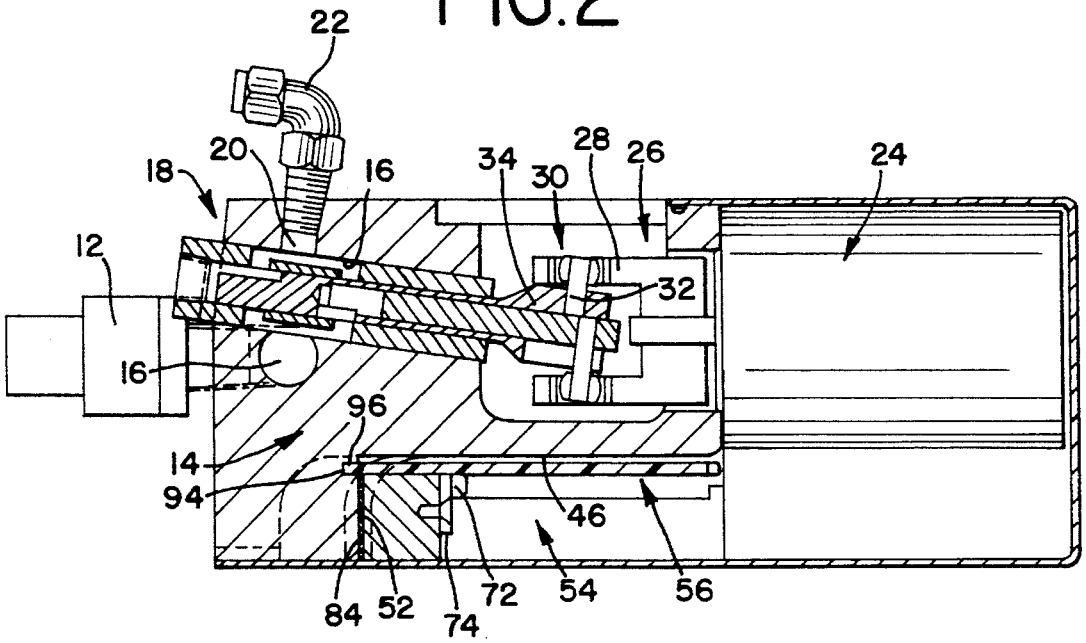
FIG. 2 is a vertical sectional view, taken along lines 2—2 of FIG. 1, and showing the configuration of the circuitboard mounting arrangement of the page pack.

As shown in FIG. 2, drive motors generally designated 24 cause rotation of a drive yoke assembly generally designated 26. The yoke carries at least one offset leg 28, a spherical bearing arrangement generally designated 30 for connection which receives a connecting rod 32 associated with a rotatable and reciprocable piston 34. This piston undergoes an action which was generally described above and which only incidentally forms a part of the present invention.

In keeping with the invention, the housing 14 (FIGS. 2 and 3) includes not only a plurality of openings generally designated 36 for receiving the motor yokes 26, openings 38 for receiving fasteners to secure the motor to the housing, but also include a pair of substantially identical side flanges, 40, 42 as well as an end flange 44. These elements are integrally formed, as by casting, with the body of the housing 14.

A flat machined or cast surface 46, in combination with the sidewalls 48, 50 of the flanges 40, 42 and the end wall 52 of the flange 44 define a pocket generally designated 54 for receiving a control circuitboard generally designated 56. As is shown, the control circuitboard assembly 56 includes a circuitboard proper 58 having an outer margin 60 and a surface which is suitable for mounting a plurality of electronic components 62, 64, 66. These components, which do not per se form a part of the invention, are conventional within the solid state control circuitry field and include an assortment of integrated circuit chips received in so-called dual in-line packages, various capacitors, resistors, inductors and other conventional components as well as an assortment of connecting wires, plugs, and the like.

Figure 3:
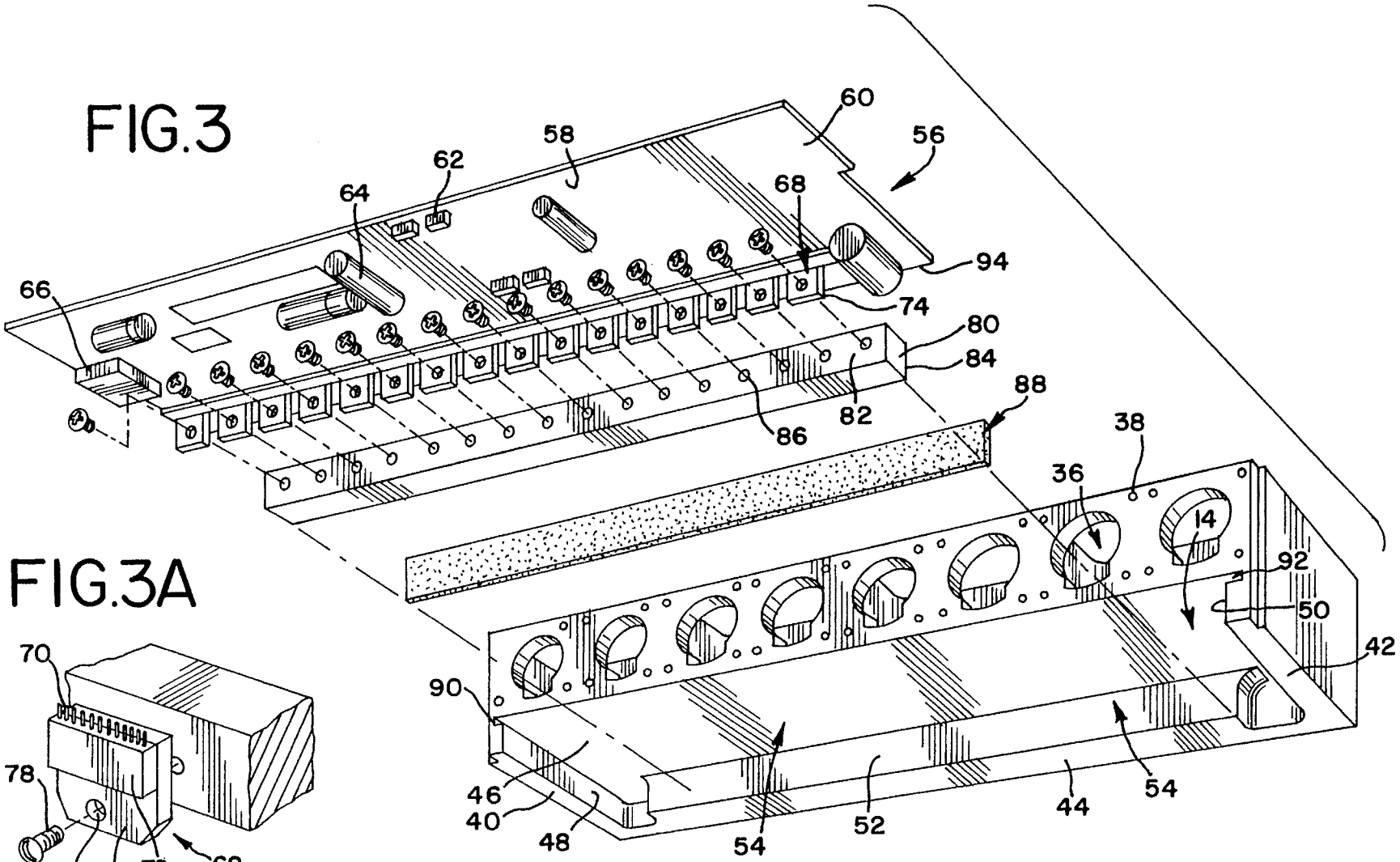
FIG. 3 is an exploded perspective view of certain elements of the invention, including the pump housing, the circuitboard, a plurality of individual heat sink units, a master heat sink unit, and a housing flange heat sink.
Figure 3A:
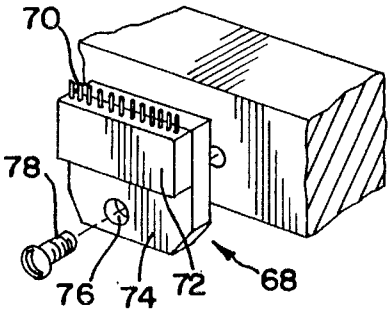
FIG. 3A is a greatly enlarged and exploded perspective view of one of the combination output driver/heat sink units of the invention and a portion of the master heat sink, showing the same prior to assembly.

According to the invention, a microprocessor (not shown in detail) is provided for control of each motor, and each microprocessor is operatively associated with two output driver assemblies generally designated 68. Each of the assemblies 68 includes multiple pins 70, a chip section 72 and an integral heat sink 74, as best shown in FIG. 3A. Each heat sink 74 is made from metal and includes a small opening 76 for receiving a fastener 78.

In further keeping with the invention, it is possible to maintain careful control of temperature rise and to minimize temperature gradients between adjacent components. As shown in FIGS. 3 and 3A, each of the individual heat sinks 74 is held in intimate heat exchange relation with a master heat sink 80 in the form of a bar having opposed flat surfaces 82, 84. The surface 82 contains a plurality of drilled and tapped openings 86 for receiving the fasteners 78 and ensuring that the metal surfaces of each individual heat sink 74 are held in intimate heat-exchange relation contact with the surface 82 of the master heat sink 80.

As is also shown in FIG. 3, a layer of highly heat conductive adhesive material generally designated 88 is provided for positioning between the surfaces 84 on the master heat sink and the surface 52 of the end flange 44 on the housing 14.

In assembling the components, it is preferred that once the circuitboard has been prepared, with the output drivers and their heat sinks being arranged so as to have the heat sink surfaces lie along a common plane, a master heat sink, preferably made from aluminum, is secured by positioning the individual fasteners in FIGS. 3 and 3A. When these connections are achieved, the circuitboard is in position with its margin 60 aligned with the slots 90, 92 lying between the flange walls 48, 50 and the housing surface 46. The circuitboard is then advanced in the slots until the end surface 94 of the board 58 is received in the slot 96 between the surface 46 and the wall 52 of the end flange 44. Here, an adhesive bond using the material 88 will secure the master heat sink to the end flange 52, retaining the board and its components in a fixed position relative to the housing.

According to the invention, such an arrangement has proven to be very satisfactory in regard to component temperature control. Although, as is commonly the case, two adjacent output drivers may be operating at completely different duty cycles—one operating continuously and the other occasionally or not at all, the additional heat sinking capacity available from portions of the master heat sink that are in contact with cooler individual heat sinks is used to reduce the temperature of the hotter-running chips. If the press is operating at high speed with a large ink requirement, the arrangement is capable of supplying adequate heat exchange and cooling capacity, but the temperature rise is still more effectively handled by permitting heat to flow into the master heat sink and be dissipated therefrom into the pump housing than trying to contain it in the small heat sinks. The temperature rise in the pump housing is moderate compared to that of the electronic devices on the board, with the ink flowing therethrough being maintained at the temperature of the pressroom.

By utilizing the foregoing arrangement, in contrast to the prior art arrangement of remotely mounting the control circuitboard remotely relative to the stepping motors, a greatly improved reliability has been achieved. In addition, the maintainability of the page packs is very greatly increased. In the rare event there is some malfunction, only one or two master plugs are required to be removed and the page pack as a whole, including its electronic circuitry may be removed and replaced for troubleshooting or repair.

With remote positioning of the components, it was necessary to detach all the various plugs and other fittings serving each motor and other various components from the page pack before removing the same. Bearing in mind that each of such included connectors is comparatively delicate, the time and effort requirements involved in removing them individually, and the accompanying downtime, had served as a significant drawback to the prior art arrangements. According to the present invention, a seven wire bus and its associated plugs are all that are required to be removed in order to replace the unit.

According to the invention, increased reliability and maintainability are provided at no increase in expense. The final page pack arrangement is advantageous from these standpoints and provides the foregoing and other advantages and characteristics in use. It will thus be seen that the present invention provides a new and improved page pack for large printing presses having a number of advantages and characteristics, including those pointed out herein and others which are inherent in the invention. A description of one form of the page pack construction of the invention having been illustrated by way of example, it is anticipated that variations and modifications of the described form of apparatus will occur to those skilled in the art and it is anticipated that such variations and changes may be made without departing from the spirit of the invention or the scope of the appended claims.

I claim:

1. In combination, a unitary housing body for receiving a plurality of positive displacement ink pumps, including a plurality of substantially parallel bores lying in a first, common plane, each of said bores having a pump cylinder and at least one pump piston disposed therein, a plurality of individual drive motors, each of said motors being operatively associated with a pump, and arranged such that the respective rotational axes of all of said motors are substantially parallel to one another and lie in a given plane, with the plane of said motor axes intersecting but being slightly inclined with respect to the plane of said pump axes, said housing body also including at least one slotted end flange and an outwardly facing housing surface portion defining a circuitboard positioning area, an electronic control circuitboard positioned adjacent said housing, surface and having a margin received within and positioned by said slot, said circuitboard including at least one high current driver unit for each pump motor, with each driver unit including a packaged circuit secured to an individual metal heat sink in heat exchange relation, with each of said individual metal heat sinks lying in a common plane and said assembly further including a master metal heat sink with each of said individual heat sinks being secured to said master heat sink in intimate heat exchange relation therewith, and with said master heat sink bar also being secured to said housing flange in intimate heat exchange relation.

2. A combination as defined in claim 1, wherein said circuitboard includes two current driver units for each pump motor.

3. A combination as defined in claim 1, wherein each of said individual metal heat sinks is secured to said master metal heat sink by removable fasteners extending through said individual metal heat sinks.

4. A combination as defined in claim 1, which further includes a protective cover carried by said housing and having portions serving to enclose said circuitboard positioning area by engagement with said flange and other components of said housing body.

5. A combination as defined in claim 1, wherein each of said individual drive motors is a stepping motor and each of said drivers provides an output pulse for each of said motor steps.

6. A combination as defined in claim 1, wherein said housing body is made from aluminum.

7. A combination as defined in claim 1, wherein said master metal heat sink is secured to said housing flange by an adhesive that is highly heat conductive.

8. In combination, a unitary housing body for receiving a plurality of positive displacement ink pumps, including a plurality of substantially parallel bores lying in a first, common plane, each of said bores having a pump cylinder and at least one pump piston disposed therein, a plurality of individual drive motors, each of said motors being operatively associated with a pump, and arranged such that the respective rotational axes of all of said motors are substantially parallel to one another and lie in a given plane, with the plane of said motor axes intersecting but being slightly, inclined with respect to the plane of said pump axes, said housing body also including an end flange, a pair of spaced apart side flanges and an outwardly facing housing surface portion, with said flanges and said surfaces defining a pocket for receiving a circuitboard, an electronic control circuitboard positioned substantially within said pocket, adjacent said housing surface and having its margins received within and positioned by slots in each of said flanges, said circuitboard including at least one high current driver unit for each pump motor, with each driver unit including a packaged circuit secured to an individual metal heat sink in heat exchange relation, with each of said individual metal heat sinks lying in a common plane and said assembly further including a master metal heat sink in bar form, with each of said individual heat sinks having fastener openings therein and being secured with removable fasteners to said master heat sink in intimate heat exchange relation therewith, and with said master heat sink bar also being secured in intimate heat exchange relation to said housing end flange.

9. A combination as defined in claim 8, wherein said at least one high current driver unit for each pump motor comprises two high current driver units for each motor.

10. A combination as set forth in claim 8, wherein said individual metal heat sinks are secured by metal fasteners to said master metal heat sink and wherein said master metal heat sink is secured to said housing end flange by a thermally conductive adhesive material.

* * * * *